US005184923A

United States Patent [19]

Calandra, Jr. et al.

[11] Patent Number: 5,184,923

[45] Date of Patent: Feb. 9, 1993

[54] EXPANSION SHELL ASSEMBLY

[75] Inventors: Frank Calandra, Jr., Pittsburgh; John C. Stankus, Canonsburg; Paul A. Yacisin, Patton, all of Pa.

[73] Assignee: Jennmar Corporation, Pittsburgh, Pa.

[21] Appl. No.: 790,242

[22] Filed: Nov. 8, 1991

[51] Int. Cl.[5] ..... E21D 20/02

[52] U.S. Cl. ..... 405/259.4; 405/259.6; 411/45

[58] Field of Search ..... 405/259.1, 259.4, 259.5, 405/259.6; 411/45, 57

[56] References Cited

U.S. PATENT DOCUMENTS

| | | | |
|---|---|---|---|
| 4,437,795 | 3/1984 | White | 405/259.4 X |
| 4,556,344 | 12/1985 | White | 405/259.6 |
| 4,611,954 | 9/1986 | Cassidy | 405/259.1 X |
| 4,764,055 | 8/1988 | Clark et al. | 405/259.6 X |
| 5,073,064 | 12/1991 | Leonard et al. | 405/259.6 |

*Primary Examiner*—David H. Corbin
*Attorney, Agent, or Firm*—Stanley J. Price, Jr.

[57] ABSTRACT

A tapered camming plug positioned within an expansion shell is threaded onto an upper end portion of an elongated bolt advanced behind a resin cartridge system into a bore hole drilled in a rock formation. A bearing plate is carried on the opposite end of the bolt and abuts the rock formation surrounding the bore hole. The cartridge is ruptured by upward thrust and rotation of the bolt to release the resin components for mixing. The mixed resin flows downwardly in the bore hole into surrounding relation with the camming plug and expansion shell. The expansion shell includes a plurality of expansion fingers each formed integral at one end portion with a ring end portion of the shell and extending upwardly to a free end portion for outward expansion into engagement with the wall of the bore hole as the camming plug advances downwardly on the bolt after the resin is mixed. The shell ring end portion has a circular opening for receiving the bolt and an outer, non-circular surface forming a wall having areas of non-uniform thickness to increase the area of the annulus between the ring end portion and the wall of the bore hole. The increased area around the ring end portion facilitates the insertion of the expansion shell assembly into the resin by permitting the resin to flow past the shell and the ring end portion and bond the expansion shell and a portion of the bolt to the rock formation within the bore hole.

20 Claims, 2 Drawing Sheets

EXPANSION SHELL ASSEMBLY

BACKGROUND OF THE INVENTION

1. Field of the Invention

This invention relates to an improved expansion shell assembly for mine roof bolts and more particularly to an expansion shell that facilitates the flow of resin into surrounding relation with the shell.

2. Description of the Prior Art

It is well known in the art of mine roof control to tension bolts anchored in bore holes drilled into the mine roof in order to reinforce the unsupported rock formation above the roof. Conventionally, a hole is drilled into the rock formation. The end of the bolt in the rock formation is anchored either by engagement of an expansion shell assembly on the end of the bolt with the rock formation, by bonding the bolt with resin to the rock formation surrounding the bore hole, or by use of both an expansion shell assembly and resin together to retain the bolt within the hole.

Examples of an arrangement utilizing both an expansion shell assembly and resin to anchor a mine roof bolt in a rock formation are disclosed in U.S. Pat. Nos. 4,419,805; 4,413,930; 4,516,885 and 4,518,292. Other examples of both an expansion shell assembly and resin to anchor a mine roof bolt are shown in U.S. Pat. Nos. 3,188,815; 4,162,133; 4,655,645 and 4,664,561.

Mechanical expansion shell assemblies for roof bolts have been used for many years without resin in the anchorage of the bolts in rock formation. Many improvements have been proposed to the configuration of various components of the expansion shell assemblies to provide better anchoring within the bore hole. When mechanical anchor assemblies are utilized in conjunction with resin bonding material, additional modifications are often made to accommodate the resin bonding material. U.S. Pat. No. 4,764,055 discloses an expansion shell assembly modified in many respects to accommodate the use of resin bonding material with the mechanical expansion shell assembly.

For many applications, it has been found desirable to use small diameter bore holes within which to install mine roof bolts. When small diameter bore holes are utilized, the power required to drill the bore hole is greatly reduced, the size and weight of the drill steel is reduced and the size and weight of the roof bolt utilized in the small diameter hole is also reduced, providing for cost savings and more efficient roof control.

It has been determined that a roof bolt with a mechanical expansion assembly can be very effectively utilized in a one inch bore hole if the mechanical expansion shell assembly is properly arranged to provide strong gripping action on the inside of the bore hole. When used with a resin system, it is important that the resin components be thoroughly mixed. The expansion shell assembly must penetrate the mixed resin to assure that the resin completely surrounds the assembly for secure bonding of the assembly to the surrounding rock formation. This is particularly important for small diameter bore holes.

A conventional expansion shell assembly includes a tapered plug threaded onto the end of a mine roof bolt and positioned within an expansion shell. The tapered plug advances downwardly on the bolt as the bolt is rotated. As the plug moves downwardly it urges the expansion leaves to expand or deflect radially outwardly to grip the rock formation surrounding the bore hole.

Generally, expansion shell assemblies are of two types. One type has a base portion in the configuration of a ring or collar to which are integrally affixed a plurality of upwardly extending expansion leaves or fingers spaced from one another and having free end portions. The leaves and ring surround the bolt. As the tapered plug moves downwardly toward the ring, the leaves bend outwardly into gripping engagement with the rock formation. Another general type of expansion shell is a bail-type shell in which two expansion leaves are supported by a bail that extends over the end of the mine roof bolt and prevents the expansion leaves from moving axially relative to the bolt.

The present invention is directed to an improved expansion shell assembly of the type having a plurality of expansion leaves integrally affixed to a collar to form an expansion shell. U.S. Pat. No. 4,764,055 discloses an expansion shell assembly representative of this general configuration. While expansion shell assemblies for anchoring mine roof bolts in bore holes are well known, there is need to improve the gripping power of the expansion shell when expanded in the bore hole of a rock formation, such as a mine roof. Particularly when used with a mixed resin system, the expansion shell must pass freely in the bore hole to penetrate the resin. The resin must flow in and around the shell so that the shell is encapsulated in the resin. Therefore, there is need to provide an expansion shell that promotes the flow of the resin in complete surrounding relation with the shell to assure secure bonding of the shell to the rock formation.

SUMMARY OF THE INVENTION

In accordance with the present invention, there is provided an apparatus for supporting a rock formation that includes an elongated bolt positioned in a bore hole of a rock formation. The bolt has a threaded first end portion and a second end portion. The bolt first end portion is positioned adjacent to the end of the bore hole. The bolt second end portion extends out of the bore hole and has a rectangular nut formed thereon. An expansion shell is positioned on the bolt first end portion. A roof plate is positioned on the bolt second end portion and is arranged to bear against the rock formation at the open end portion of the bore hole. The expansion shell has a support ring and a plurality of longitudinally extending fingers spaced from one another forming elongated slots therebetween. The fingers are each integrally formed at one end portion with the support ring and extend upwardly therefrom to form a free end portion for outward expansion of the fingers. Camming means is threadedly engaged to the bolt first end portion within the expansion shell and is arranged to expand the fingers outwardly into contact with the wall of the bore hole upon rotation of the bolt as the camming means moves axially on the bolt relative to the expansion shell. The expansion shell support ring has an internal bore for receiving the bolt first end portion and an external surface positioned adjacent to of the wall of the bore hole. The support ring external surface has a reduced diameter portion to facilitate the unobstructed insertion and movement of the expansion shell upwardly into the bore hole to anchor the rod in a fixed position in the bore hole.

Further in accordance with the present invention, there is provided a method for anchoring a bolt in a bore hole that includes the steps of inserting unmixed resin material for mixing in a bore hole. An elongated bolt having an assembled expansion shell and plug member positioned on the end thereof is advanced into the bore hole. A portion of a collar or ring of the expansion shell is displaced from the wall of the bore hole to provide between the collar and the wall of the tore hole an annulus with a portion of increased area. Flow of resin material is directed downwardly into surrounding relation with the surface of the expansion shell and plug member. The flow of resin material past the shell collar is promoted by the flow of resin material through the annulus portion of increased area between the shell collar and wall of the bore hole. The bolt and the expansion shell are rotated to effect mixing of the resin material in the bore hole.

Additionally, the present invention is directed to an expansion shell assembly for anchoring a bolt in a bore hole containing resin that includes an expansion shell having a base portion and a plurality of longitudinally extending fingers equally spaced from one another forming elongated slots therebetween. The fingers are each formed integral at one end portion with the base portion and extend upwardly therefrom to form a free end portion for outward expansion of the fingers. The fingers each have an outer surface for frictionally engaging the wall of the bore hole upon upward expansion of the fingers. The shell base portion has a ring end portion with an opening therethrough for receiving the bolt. The ring end portion has an outer, non-circular surface forming a wall having areas of reduced thickness to increase the area of the annulus between the shell base portion and the wall of the bore hole to facilitate insertion of the expansion shell into resin in the bore hole.

Accordingly, a principal object of the present invention is to provide method and apparatus for supporting a rock formation by anchoring an elongated bolt in a bore hole of the rock formation using an expansion shell assembly mechanically expanded into gripping engagement with the wall of the tore hole and adhesively bonded thereto by a resin in which the expansion shell assembly has a configuration which promotes the displacement of resin by the expansion shell assembly and penetration of the expansion shell assembly into the resin.

Another object of the present invention is to provide an expansion shell assembly for anchoring a bolt in a rock formation utilizing an expansion shell having a base portion which promotes the flow of mixed resin into surrounding relation with the shell to securely bond the shell to the rock formation in the bore hole.

A further object of the present invention is to provide an expansion shell, having a ring end portion with an oval-shaped configuration that increases a portion of the annular space around the ring end portion within a bore hole to facilitate the pentration of the expansion shell assembly into the resin by permitting the resin to flow past the shell and ring end portion and bond the expansion shell assembly and a portion of the bolt to the wall of the bore hole.

These and other objects of the present invention will be more completely disclosed and described in the following specification, the accompanying drawings, and the appended claims.

DESCRIPTION OF THE PREFERRED EMBODIMENTS

Figure 7:
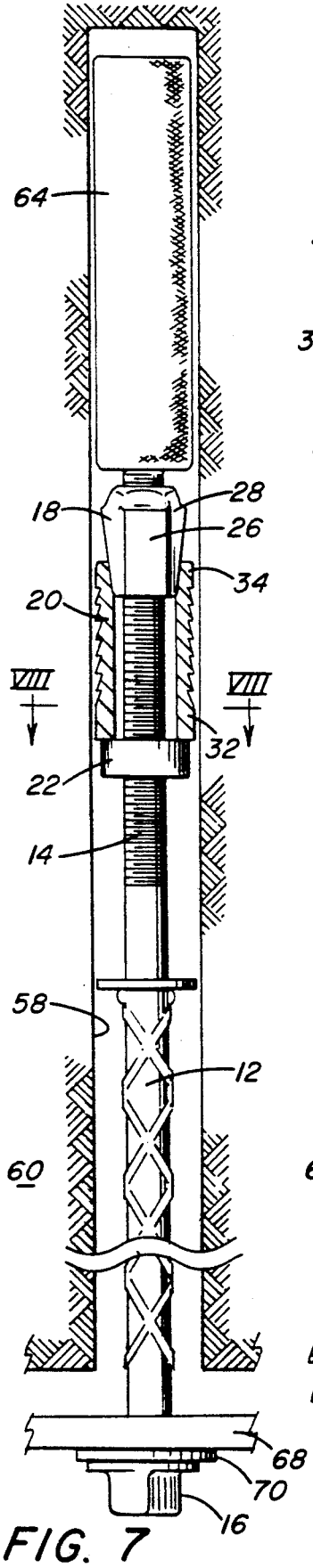
FIG. 7 is a partial fragmentary view in side elevation of the expansion shell assembly positioned on a mine roof bolt and inserted in a bore hole with a resin cartridge prior to fracturing the resin cartridge.

Referring to the drawings and particularly to FIGS. 1-6, there is shown an expansion shell assembly generally designated by the numeral 10 threaded onto a mine roof bolt 12. The mine roof bolt 12 has an upper threaded end 14 and at the opposite end as shown in FIG. 7 a head 16 formed integrally therewith. The roof bolt 12 may be formed either as a smooth bolt having the threaded end 14 and head 16 or as a rebar that has a threaded end 14 and a head 16.

Figure 5:
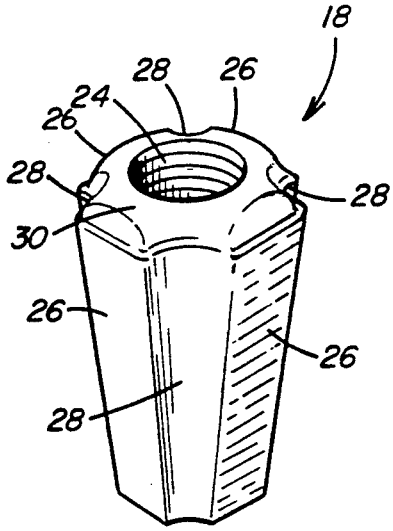
FIG. 5 is an isometric view of a tapered plug received within the expansion shell as shown in FIG. 1.
Figure 6:
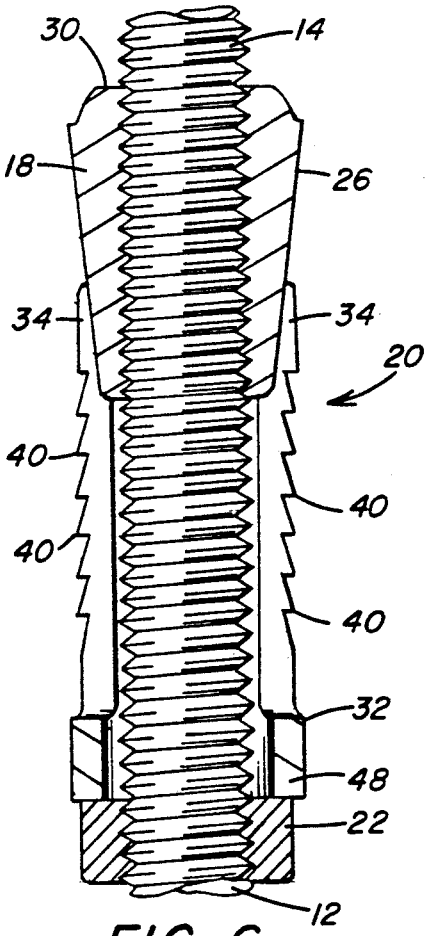
FIG. 6 is an enlarged cross sectional view in side elevation of the expansion shell assembly positioned on a mine roof bolt, illustrating the enlarged outer dimension of the ring portion.

The expansion shell assembly 10 includes a tapered camming plug 18, an expansion shell 20 and a stop washer 22. The tapered camming plug 18 has internal threads 24, as shown in FIGS. 5 and 6, so that it threadedly engages the threaded end portion 14 of bolt 12. Preferably the plug 18 has four tapered surfaces 26 that are longitudinally separated by grooves 28. The tapered plug 18 has a rounded end 30 to enable the tapered plug to penetrate and displace resin as the assembly 10 is inserted into the bore hole of a rock formation. The grooves 28 permit the resin to pass longitudinally down past the plug 18 into the inner portion of the shell and into an annular opening between the shell and the bore hole wall surrounding shell 20.

Figure 1:
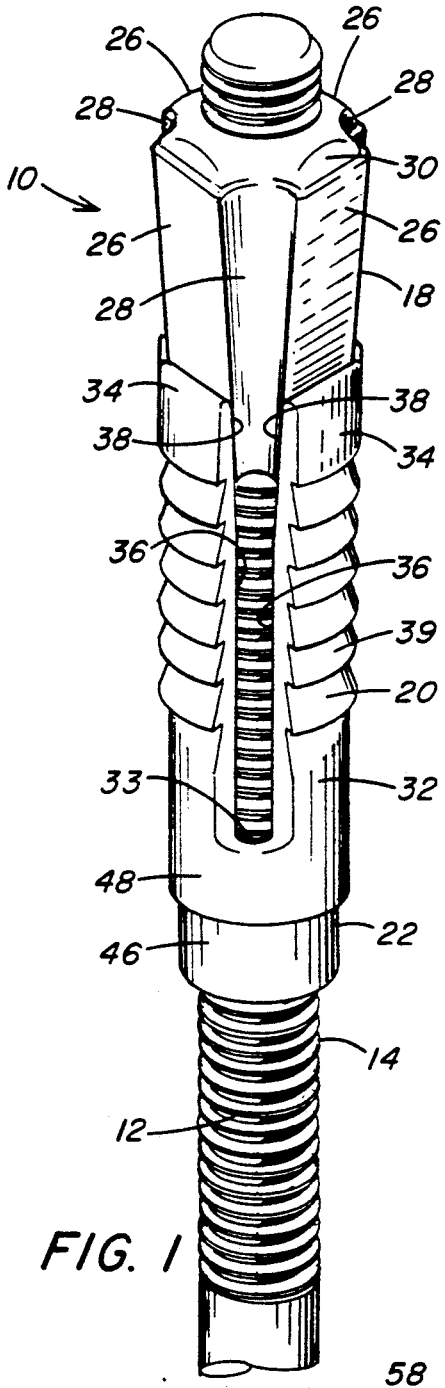
FIG. 1 is an isometric view of an expansion shell assembly of the present invention on the end of a mine roof bolt.
Figure 2:
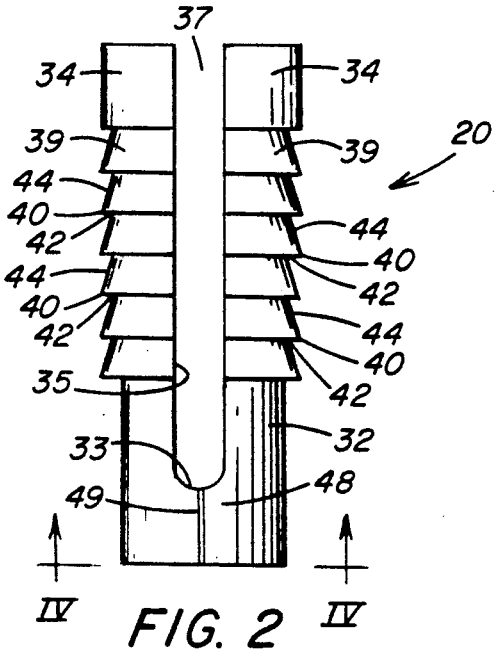
FIG. 2 is a view in side elevation of an expansion shell shown in FIG. 1, illustrating a portion of the shell ring portion having a reduced outer dimension.
Figure 3:
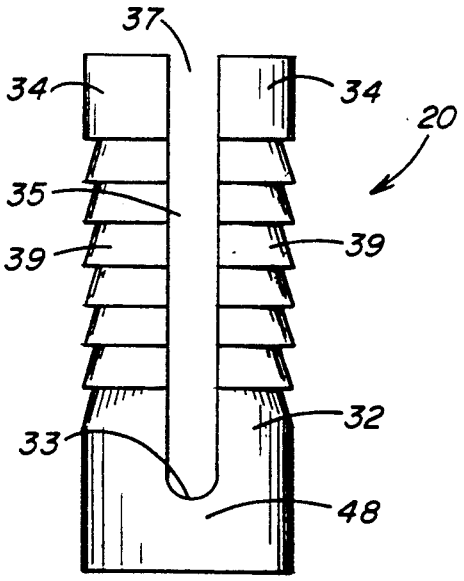
FIG. 3 is another view in side elevation of the expansion shell, illustrating the shell rotated 90° with respect to the position of the expansion shell shown in FIG. 2 where the ring portion has an enlarged outer dimension.

The expansion shell 20 has a support ring or collar 32 that encircles the bottom portion of the expansion shell 20. Four fingers or leaves 34 are formed integrally with the ring 32 and extend axially upwardly from the support ring 32 as seen in FIG. 1. The leaves 34 are equally spaced from one another forming longitudinally extending slots 35 therebetween. Each of the slots has a closed end portion 33 spaced from the shell support ring 32 and an opposite open end portion 37, thus forming a free end portion of each leaf 34. With this arrangement, the leaves 34 are operable to expand outwardly about the support ring 32. The leaves 34 are formed integrally with the ring 32 and have smooth internal surfaces 36 with tapered portions 38 to register with the tapered surfaces 26 of camming plug 18.

Each of the leaves 34 includes an outer gripping surface 39 and smooth inner surfaces 36. The gripping surface 39 of each finger includes a series of spaced parallel, tapered serrations 40. The serrations 40 are formed by the intersection of planar surfaces 42 that are perpendicular to the axis of the roof bolt 12 when the expansion shell 20 is in an unexpanded condition and by frusto-conical surfaces 44 whose conical axis coincides with the axis of the roof bolt 12.

In one example of the expansion shell assembly 10 of the present invention, the assembly 10 is designed to be utilized in a bore hole having a nominal diameter of 1". The roof bolt 12 has a nominal diameter of $\frac{5}{8}$". The maximum diameter of the tapered plug 18 is 0.960" and the maximum diameter of the unexpanded expansion shell 20 is 0.938".

The expansion shell 20 fits freely around roof bolt 12 and is supported on the roof bolt by stop washer 22. Stop washer 22 is threadingly received on the roof bolt threaded end 14 and has a cylindrical external surface 46. The diameter of cylindrical external surface 46 is less than the unexpanded diameter of expansion shell 20 so as not to inhibit the flow of resin down and around the expansion shell assembly 10.

Figure 4:
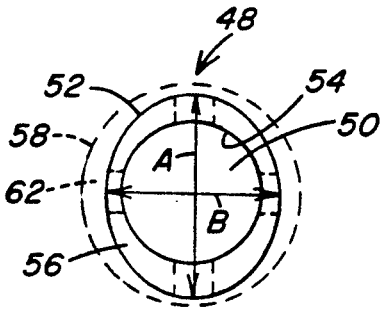
FIG. 4 is a view of the expansion shell taken along line IV—IV of FIG. 2, illustrating the oval shape ring end portion of the expansion shell with the outline of a bore hole of a rock formation shown in a dashed line around the ring portion.

The washer 22 is threadedly advanced on the bolt threaded end 14 into abutting relation with the shell support ring 32 to fix the position of the expansion shell 20 on the bolt 12. The support ring 32 has a base portion 48, as seen in FIG. 4, which includes a substantially circular opening 50 through which the bolt 12 extends. The diameter of the opening 50 is slightly larger than the diameter of the bolt 12, which has a nominal diameter of $\frac{5}{8}$" in one example, to permit the bolt 12 to pass in an unobstructed manner through the base portion 48.

The shell base portion 48 has an outer surface 52 and an inner surface 54 forming a wall 56 having a non-uniform thickness as shown in FIG. 4. As seen in FIG. 4, the base portion outer surface 52 has an oval or oblong configuration to provide the base portion outer surface 52 with a major axis A and a minor axis B. The major axis A is greater than the minor axis B. This provides the base portion 48 with the wall 56 having a non-uniform wall thickness. The wall thickness 56 has a maximum outer dimension along the major axis A and a minimum outer dimension along the minor axis B.

Figure 8:
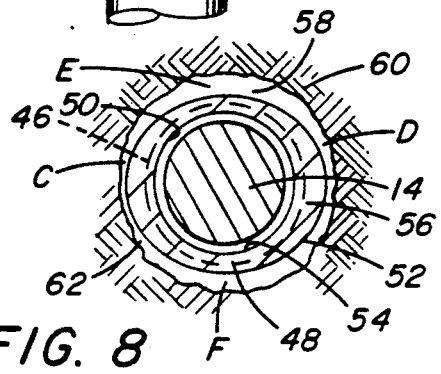
FIG. 8 is a sectional view of the expansion shell assembly taken along line VIII—VIII of FIG. 7, illustrating the annulus between the shell ring portion and wall of the bore hole where the annulus has enlarged portions and reduced portions.
Figure 9:
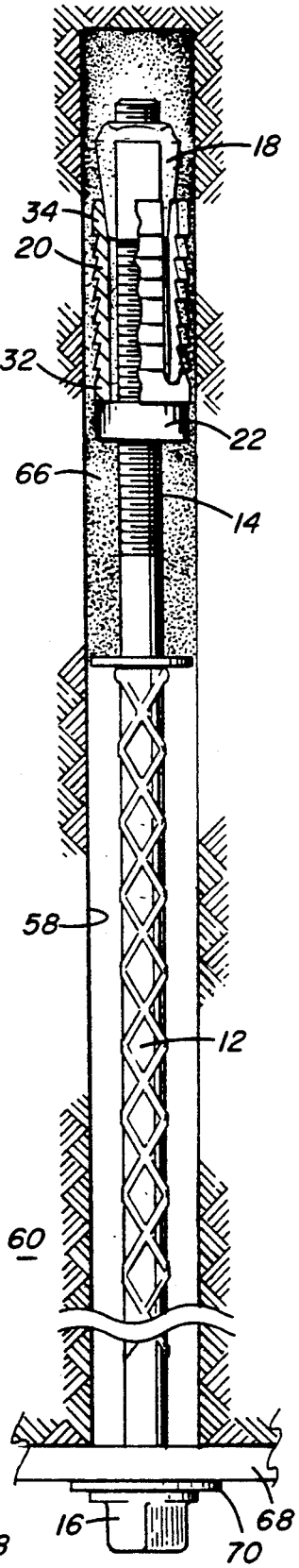
FIG. 9 is a view of the expansion shell assembly rotated 90° from the position of the assembly shown in FIG. 7 and penetrating the resin released from the ruptured cartridge prior to expansion of the shell, illustrating flow of the resin through the annulus between the shell ring portion and bore hole wall and past the shell assembly.

When the expansion shell assembly 10 is positioned on the bolt end 14 and inserted in a bore hole 58 of a rock formation 60 as shown in FIGS. 7-9, an annular space 62 is formed between the support ring or collar 32 and the wall of the bore hole 58. At the oval shaped base portion 48 of the ring 32, the annular space 62 between the ring 32 and the wall of the bore hole 58 varies around the ring 32. The annular space 62 is at a minimum opposite the major axis A and at a maximum opposite the minor axis B. For example, as shown in FIG. 8, the annular space 62 at points C and D is at a minimum and at points E and F at a maximum. The increase in the annular space at points E and F is formed by the oval shaped base portion 48.

The provision of the oval-shaped base portion 48 and the creation of the expanded area of the annular space 62 at points E and F, shown in FIG. 8, forms paths for the flow of resin into surrounding relation with and past the shell support ring 32. Penetration of the expansion shell 20 into the resin in the bore hole 58 is enhanced by flow of the resin through the flow paths corresponding to the expanded area of the annular space 62 at points E and F. This is accomplished without the need to apply excessive inserting pressure on the bolt. This is particularly important for the anchorage of $\frac{5}{8}$" roof bolts in 1" bore holes.

To insure a secure bonding of the expansion shell assembly 10 and bolt 12 by mixed and cured resin, the expansion shell 20 and the portion of the bolt 12 below the shell assembly 10 must be encapsulated within the resin. The oval-shaped base portion 48 of the expansion shell 20 of the present invention provides expanded areas of the annulus around the support ring 32 in the bore hole which permits the resin to flow around and past the shell base portion 48.

The oval-shaped base portion 48 promotes the flow of resin through the annular area 62 so that the resin completely surrounds the shell 20, including the ring 32, and a portion of the bolt 12 below the ring 32 to securely bond the expansion shell 20 and the bolt 12 to the rock formation. The provision of the oval-shaped base portion 48 permits the insertion of expansion shell assembly 10 on the end of the bolt 12 into the resin without undue pressure required to be applied to the bolt 12. By providing expanded areas of the annular area 62 around the base portion 48 in the bore hole, the penetration pressure required to insert the bolt 12 and expansion shell assembly 10 into the resin is reduced.

Further in accordance with the present invention, the oval or elliptically-shaped base portion 48 provides a stronger base for the expansion shell 20 at a foundry parting line 49 (shown in FIG. 2) of the shell. The foundry parting line 49 is formed at the interface of the top and bottom sections of the mold used in casting the expansion shell 20. The top and bottom mold sections for forming the shell 20 in the foundry process are not illustrated in the figures. However, the parting line 49 formed in the casting of the shell 20 lies coincident with the major axis A of the base portion 48 shown in FIG. 4.

As discussed above, the wall thickness 56 of base portion 48 has a maximum outer dimension along the major axis A. By locating the foundry parting line 49 on the major axis A where the wall thickness of the shell base portion 48 is the greatest, the structural strength of the base portion 48 is increased. Accordingly, if the parting line 49 were located on the minor axis B where the wall thickness is a minimum, then the base portion 48 would be weakened. Thus, by providing the base portion 48 with an elliptical shape, the base portion 48 is strengthened at the foundry parting line 49.

As seen in FIGS. 7-9, the expansion shell assembly 10 and roof bolt 12 are utilized in a bore hole 58 formed within a rock formation 60 such as a mine roof. In this instance, the expansion shell assembly 10 and roof bolt 12 are utilized with resin bonding. It will be appreciated that the expansion assembly 10 of the present invention can also be used in conventional bolting without resin.

As shown in FIG. 7, a resin cartridge 64 is positioned within the bore hole 58 above the expansion shell assembly 10. Expansion shell assembly 10 and roof bolt 12 are thrust upwardly in the bore hole 58 to rupture the resin cartridge 64. The resin components are released to mix and flow downwardly over the expansion shell assembly 10, as shown in FIG. 9. A portion of the resin in the bore hole 58 is displaced by the expansion shell assembly 10 and flows downwardly into the annular area 62 between the assembly 10 and wall of the bore hole 58. The flow of resin is promoted through the expanded area of the annular space 62 and past the assembly 10 to a position below the assembly 10 where a stopper 72 is positioned on the bolt 12 to confine the resin in the area of the bore hole 58 around the expansion shell assembly 10.

As the roof bolt 12 is rotated, the contents of the resin cartridge 64 are mixed together to form a free flowing resin 66 as shown in FIG. 9. A roof plate 68 and washer 70 surround roof bolt 12 at bolt head 16 below the bore hole 58. The roof plate 68 is drawn upwardly against the mine roof 60. After the resin is thoroughly mixed, continued rotation of the roof bolt 12 advances the plug 18 downwardly on the bolt 12 within the shell 20. Downward movement of the plug 18 expands the shell 20 into gripping engagement with the wall of the bore hole 58.

Because of the construction of the oval-shaped base portion 48 of shell 20, the expansion shell assembly 10 passes easily up into the free resin 54 and the resin flows downwardly around and past the assembly 10 and around an upper portion of the bolt 12. Thus, the expansion shell assembly 10 of the present invention may readily be utilized with a resin system to provide a secure anchor within the bore hole 58. However, it should also be understood that the configuration of the expansion shell 20 of the present invention provides a very efficient mechanical expansion arrangement for a mine roof bolt even when utilized without resin bonding.

According to the provisions of the patent statutes, I have explained the principle, preferred construction and mode of operation of my invention and have illustrated and described what I now consider to represent its best embodiment. However, it should be understood that, within the scope of the appended claims, the invention may be practiced otherwise than as specifically illustrated and described.

I claim:

1. Apparatus for supporting a rock formation comprising, an elongated bolt positioned in a bore hole of a rock formation, said bolt having a threaded first end portion and a second end portion, said bolt first end portion being positioned adjacent to the end of the bore hole, said bolt second end portion extending out of the bore hole, an expansion shell positioned on the bolt first end portion, means positioned on the bolt second threaded end portion for bearing against the rock formation of the open end portion of the bore hole, said expansion shell having a support ring and a plurality of longitudinally extending fingers spaced from one another forming elongated slots therebetween, said fingers each integrally formed at one end portion with the support ring and extending upwardly therefrom to form a free end portion for outward expansion of the fingers, camming means threadedly engaged to the bolt threaded end portion within the expansion shell for expanding the fingers outwardly into contact with the wall of the bore hole upon rotation of said bolt as said camming means moves axially on said bolt relative to said expansion shell, said expansion shell support ring having an external surface positioned adjacent to the wall of the bore hole and an internal surface forming a bore in said expansion shell for receiving the bolt first end portion, and said support ring external surface and said internal surface forming a wall extending around said support ring and ranging in thickness between a maximum thickness and a minimum thickness to facilitate the unobstructed insertion and movement of said expansion shell upwardly into the bore hole to anchor said bolt in a fixed position in the bore hole.

2. Apparatus as set forth in claim 1 in which, said support ring has an oval shape defined by a major axis and a minor axis, and said minor axis being spaced from the wall of the bore hole a greater distance than said major axis to form around said support ring an enlarged area between said support ring and the wall of the bore hole.

3. Apparatus as set forth in claim 1 in which, said support ring internal bore has a preselected diameter and said support ring external surface has a configuration defined by a major axis and a minor axis.

4. Apparatus as set forth in claim 1 in which said support ring has a preselected shape such that selected areas of said support ring are spaced further from the wall of the bore hole than the remaining areas of said support ring to form an annular space around said support ring having portions of increased area and decreased area between said support ring and the wall of the bore hole.

5. Apparatus as set forth in claim 1 in which said support ring has a circular internal bore and an oval-shaped external surface.

6. Apparatus for supporting a rock formation comprising, an elongated bolt positioned in a bore hole of a rock formation, said bolt having a threaded first end portion and a second end portion, said bolt first end portion being positioned adjacent to the end of the bore hole, said bolt second end portion extending out of the bore hole, an expansion shell positioned on the bolt first end portion, means positioned on the bolt second threaded end portion for boring against the rock formation of the open end portion of the bore hole, said expansion shell having a support ring and a plurality of longitudinally extending fingers spaced from one another forming elongated slots therebetween, said fingers each integrally formed at one end portion with the support ring and extending upwardly therefrom to form a free end portion for outward expansion of the fingers, camming means threadedly engaged to the bolt threaded end portion within the expansion shell for expanding the fingers outwardly into contact with the wall of the bore hole upon rotation of said bolt as said camming means moves axially on said bolt relative to said expansion shell, said expansion shell support ring having an internal bore for receiving the bolt first end portion and an external surface positioned adjacent to the wall of the bore hole, and said support ring has an oval configuration to facilitate the unobstructed insertion and movement of said expansion shell upwardly into the bore hole to anchor said bolt in a fixed position in the bore hole.

7. Apparatus for supporting a rock formation comprising, an elongated bolt positioned in a bore hole of a rock formation, said bolt having a threaded first end portion and a second end portion, said bolt first end portion being positioned adjacent to the end of the bore hole, said bolt second end portion extending out of the bore hole, an expansion shell positioned on the bolt first end portion means positioned on the bolt sensed threaded end portion for bearing against the rock formation of the open end portion of the bore hole, said expansion shell having a support ring and a plurality of longitudinally extending fingers spaced from one another forming elongated slots therebetween, said fingers each integrally formed at one end portion with the support ring and extending upwardly therefrom to form a free end portion for outward expansion of the fingers, camming means threadedly engaged to the bolt threaded end portion within the expansion shell for expanding the fingers outwardly into contact with the wall of the bore hole upon rotation of said bolt as said camming means moves axially on said bolt relative to said expansion shell, said expansion shell support ring having an internal bore for receiving the bolt first end portion and an external surface positioned adjacent to the wall of the bore hole, said support ring internal bore has a fixed diameter and forms with said external surface an end wall of said support ring, and said end wall having a non-uniform thickness ranging between a minimum thickness and a maximum thickness.

8. Apparatus as set forth in claim 7 in which, said end wall has a minimum thickness at a first pair of diametrically opposed areas thereon, and said end wall has a maximum thickness at a second pair of diametrically opposed areas thereon.

9. Apparatus as set forth in claim 8 in which, said first pair of diametrically opposed areas are displaced on said end wall 90° from said second pair of diametrically opposed areas.

10. A method for anchoring a bolt in a bore hole comprising the steps of, inserting unmixed resin material for mixing in a bore hole, advancing an elongated bolt having an assembled expansion shell and plug member positioned on the end thereof into the bore hole, displacing a portion of a collar encircling the base of the expansion shell from a circular configuration to a preselected configuration providing between the collar and the wall of the bore hole an annulus with a portion of increased area, directing flow of resin material downwardly into surrounding relation with the surface of the expansion shell and plug member, promoting the flow of resin material past the shell collar by the flow of the resin material through the annulus portion of increased area between the shell collar and wall of the bore hole, and rotating the bolt and the expansion shell to effect mixing of the resin material in the bore hole.

11. A method as set forth in claim 10 which includes, increasing the area of the annulus between the shell collar and wall of the bore hole by reducing the thickness of the collar at a pair of diametrically opposed areas on the collar to increase the spacing at said opposed areas between the shell collar and the wall of the bore hole.

12. A method as set forth in claim 10 which includes, expanding the annulus between the shell collar and the wall of the bore hole by increasing a the spacing therebetween at a pair of diametrically opposed areas in the annulus to provide an increased area for the resin material to flow past the shell collar.

13. A method as set forth in claim 10 which includes, displacing the shell collar from the wall of the bore hole at a pair of diametrically areas a distance greater than the distance of the remaining areas of the shell collar from the wall of the bore hole.

14. A method for anchoring a bolt in a bore hole comprising the steps of, inserting unmixed resin material for mixing in a bore hole, advancing an elongated bolt having an assembled expansion shell and plug member positioned on the end thereof into the bore hole, providing the shell collar with an oval configuration having a major axis and a minor axis where the portions of the shell collar on the minor axis are spaced a greater distance from the wall of the bore hole than the portions of the shell collar on the major axis, displacing a portion of a collar of the expansion shell from the wall of the bore hole to provide between the collar and the wall of the bore hole an annulus with a portion of increased area, directing flow of resin material downwardly into surrounding relation with the surface of the expansion shell and plug member, promoting the flow of resin material past the shell collar by the flow of the resin material through the annulus portion of increased area between the shell collar and wall of the bore hole, and rotating the bolt and the expansion shell to effect mixing of the resin material in the bore hole.

15. An expansion shell assembly for anchoring a bolt in a bore hole containing resin comprising, an expansion shell having a base portion and a plurality of longitudinally extending fingers equally spaced from one another forming elongated slots therebetween, said fingers each formed integral at one end portion with said base portion and extending upwardly therefrom to form a free end portion for outward expansion of said fingers, said fingers each having an outer surface for frictionally engaging the wall of the bore hole upon outward expansion of the fingers, said shell base portion having a ring end portion with an opening therethrough for receiving the bolt, and said ring end portion having a wall with a thickness formed by an inner surface and an outer surface, said wall having areas of reduced thickness to increase the area of the annulus between said shell base portion and the wall of the bore hole to facilitate insertion of said expansion shell into resin in the bore hole.

16. An expansion shell assembly as set forth in claim 15 in which, said ring end portion is defined by a major axis and a minor axis, and said wall at said minor axis being displaced from the wall of the bore hole a greater distance than said wall at said major axis to form around said support ring an expanded area between said support ring and the wall of the bore hole.

17. An expansion sell assembly as set forth in claim 15 in which, said wall of said ring end portion has a minimum thickness at a first pair of diametrically opposed areas on said wall and a maximum thickness at a second pair of diametrically opposed areas on said wall, and said first pair of areas of said wall being displaced from said second pair of areas of said wall.

18. An expansion shell assembly as set forth in claim 17 in which said first pair of areas of said wall are displaced 90° from said second pair of areas of said wall.

19. An expansion shell assembly as set forth in claim 15 in which, said opening in said ring end portion is formed by said wall inner surface in a circular configuration having a preselected diameter, and said wall outer surface forming a configuration ranging in diameter between a minimum diameter portion and a maximum diameter portion.

20. An expansion shell assembly as set forth in claim 19 in which said wall outer surface at said minimum diameter portion is positioned oppositely of the wall of the bore hole forming an expanded area of the annulus for promoting the flow of resin material past and into surrounding relation with said ring end portion.

* * * * *